United States Patent [19]

Ishikawa et al.

[11] 4,400,225

[45] Aug. 23, 1983

[54] CR-MO STEEL FOR USE AS VERY THICK PLATES OF 75 MM OR MORE FOR OIL REFINERY, COAL LIQUEFACTION AND COAL GASIFICATION EQUIPMENT

[75] Inventors: Masaaki Ishikawa; Syuzo Ueda; Makoto Imanaka, all of Chiba, Japan

[73] Assignee: Kawasaki Steel Corporation, Hyogo, Japan

[21] Appl. No.: 298,147

[22] Filed: Aug. 31, 1981

[30] Foreign Application Priority Data

Aug. 29, 1980 [JP] Japan ..... 55-118359

[51] Int. Cl.[3] ..... C22C 38/32

[52] U.S. Cl. ..... 148/36; 75/124; 75/126 P

[58] Field of Search ..... 75/124 B, 126 C, 126 P; 148/36

[56] References Cited

U.S. PATENT DOCUMENTS

| | | | |
|---|---|---|---|
| 3,328,211 | 6/1967 | Nakamura et al. | 148/12 F |
| 3,463,677 | 8/1969 | Nakamura et al. | 75/126 P |

FOREIGN PATENT DOCUMENTS

| | | | |
|---|---|---|---|
| 55-24966 | 2/1980 | Japan | 75/124 B |
| 55-115952 | 9/1980 | Japan | 75/124 |
| 55-40091 | 10/1980 | Japan | 148/36 |
| 56-72156 | 6/1981 | Japan | 75/126 C |
| 56-93858 | 7/1981 | Japan | 75/126 C |
| 861192 | 2/1961 | United Kingdom | 75/126 P |
| 921838 | 3/1963 | United Kingdom | 75/126 C |

*Primary Examiner*—Peter K. Skiff

*Attorney, Agent, or Firm*—Sughrue, Mion, Zinn, Macpeak & Seas

[57] ABSTRACT

A Cr-Mo steel which is suitable for use as extremely thick plates of 75 mm or greater for pressel vessels of oil refinery, coal liquefaction and coal gasification equipment. The Cr-Mo steel includes 0.09 to 0.17 wt % of carbon, 0.03 to 0.50 wt % of silicon, 0.45 to 0.70 wt % of manganese, 1.80 to 3.40 wt % of chromium, 0.80 to 1.20 wt % of molybdenum, 0.035 to 0.1 wt % of aluminum and 0.0010 to 0.0040 wt % of boron and the balance iron and impurities inevitably mixed in steel-making processes. The Cr-Mo steel of such compositions is highly excellent in high-temperature strength, toughness and hydrogen attack resistance.

1 Claim, No Drawings

CR-MO STEEL FOR USE AS VERY THICK PLATES OF 75 MM OR MORE FOR OIL REFINERY, COAL LIQUEFACTION AND COAL GASIFICATION EQUIPMENT

BACKGROUND OF THE INVENTION

1. Field of the Invention

The present invention relates to a Cr-Mo steel for use as very thick plates of 75 mm or more for oil refinery, coal liquefaction and coal gasification equipment, and more particularly to a Cr-Mo steel of a novel composition which is free from lowering of its strength and toughness when formed into plates of extremely large thicknesses and hence is suitable for use as plates not less than 75 mm in thickness.

2. Description of the Prior Art

Heretofore, Cr-Mo steels of the type presented by ASTM (American Society for Testing Materials) A387-22 (2¼Cr-1Mo steel) and ASTM A387-21 (3Cr-1Mo steel) have widely been employed for medium- and high-temperature pressure vessels in chemical industry, including reaction vessels for oil refining such as desulfurization units and the like. In near future extremely thick Cr-Mo steel plates will probably be employed for gigantic equipment for coal liquefaction and gasification.

This type of Cr-Mo steel is usually given normalizing and tempering and its strength and toughness are maintained by a fine tempered bainite structure. But when the rate of cooling the plate from the normalizing temperature is slow due to its increased thickness, proeutectoid ferrite is formed to decrease its strength and toughness. In order to suppress the formation of the ferrite in the manufacture of Cr-Mo steel plates of extremely large thicknesses, it is general practice in the prior art to accelerate the cooling from the normalizing temperature by what is called quenching, whereby to retain the strength and toughness of the plates.

In the case of steel materials which are subjected to ordinary normalizing and tempering to give strength and toughness, there is no problem with workability, strain and so forth in the heat treatment which follows hot forming of the steel materials into pressure vessels and the like, such as tempering and normalizing-tempering. In contrast thereto, in the case of extremely thick steel plates which are subjected to quenching to give strength and toughness, however, re-quenching is required after hot forming and this introduces difficulties in respect of workability, strain and so forth. Accordingly, for the fabrication of pressure vessels from extremely thick steel plates, there is eager demand for the development of steel materials which are assured of strength and toughness by ordinary normalizing and tempering.

It is presumed that the Cr-Mo steel will be applied to the fabrication of coal liquefaction equipment from the viewpoints of strength, especially high-temperature strength and hydrogen attack resistance, and that the coal liquefaction equipment will be operated at higher temperatures and higher pressures so as to improve the efficiency of coal liquefaction. This will necessitate an increase in the thickness and strength of the steel plate for pressure vessels of the coal liquefaction equipment and hence will inevitably call for the manufacture of 300 to 400 mm thick steel plates of the bainite structure.

Such extremely thick Cr-Mo steel plates cannot be obtained by merely quenching Cr-Mo steels of conventional composition. With such a large thickness, the steel of conventional composition, even if quenched, is subject to precipitation of the proeutectoid ferrite and hence is not immune from lowered strength and toughness. Accordingly, in the forming of an extremely thick steel plate for the pressure vessel, the formed plate must be quenched overcoming the problems of workability, strain and so forth; hence, it is highly desired to develop proper steel materials which meet such requirements. Since the pressure vessels which are made from this kind of steel materials are mostly designed in accordance with ASME (American Society of Mechanical Engineers) standards of design or standards based thereon, however, the steel materials used are also limited specifically to those of ASTM specifications or similar ones and it is not permissible to make a substantial change in the composition of the steel materials or to add special alloying elements such as Ni, V, Nb and so forth to the steel materials to such an extent as to contribute to increasing their strength. Accordingly, it has been regarded as very difficult to develop steel materials of such a composition that satisfies the requirements for forming them into plates of extremely large thicknesses.

SUMMARY OF THE INVENTION

It is a primary object of the present invention to provide a Cr-Mo steel which is highly excellent in high-temperature strength, toughness and hydrogen attack resistance and suitable for use as extremely thick plates for pressure vessels of oil refinery, coal liquefaction and coal gasification equipment which run under high-temperature and high-pressure conditions.

Briefly stated, the Cr-Mo steel of the present invention includes 0.09 to 0.17 wt% of carbon, 0.03 to 0.50 wt% of silicon, 0.45 to 0.70 wt% of manganese, 1.80 to 3.40 wt% of chromium, 0.80 to 1.20 wt% of molybdenum, 0.035 to 0.1 wt% of aluminum, 0.0010 to 0.004 wt% of boron and the balance iron and inevitable impurities.

DESCRIPTION OF THE PREFERRED EMBODIMENTS

The present inventors have made a study of the problems experienced in the prior art and, as a result of their study, found that Cr-Mo steel materials containing a slight amount of boron can be formed into plates of extremely large thicknesses.

Further, they have found that although a stress-relief annealing treatment after welding must be performed at higher temperatures and for a longer period of time as the thickness of the plate formed increases, the Cr-Mo steel containing boron satisfactorily meets the requirements for plates of large thicknesses.

The stress-relieving treatment herein mentioned is performed under such temperature-time conditions that a tempering parameter represented by T (20+log t), where T is absolute temperature and t is time, may be $(20\sim21)\times10^3$. For thick plates, the tempering parameter is selected in the range of $(20.5\sim21)\times10^3$ in many cases.

A description will be given of the composition of the Cr-Mo steel of the present invention.

At least 0.09 wt% of carbon is necessary for imparting strength and toughness to this kind of Cr-Mo steel for use as plates 75 mm or greater in thickness. The larger the carbon content is, the more the strength and toughness increase but more than 0.17 wt% of carbon impairs the weld hardenability and the weld cracking susceptibility of the plates; therefore, the carbon content is limited to 0.17 wt% or less.

It is preferred that the silicon content be minimized in terms of resistance to temper embrittlement and toughness of a weld heat-affected zone. However, in order to give a proper degree of strength, especially tensile strength at high temperature, it is necessary that the silicon be contained to such an extent as not to impair toughness, that is, in the range of 0.03 to 0.50 wt%.

The manganese content must be 0.45 wt% or more so as to provide strength and ductility. In the present invention, however, since chromium and molybdenum greatly contribute to the strength rather than manganese, there is no need of containing manganese in quantity. In addition, more than 0.70 wt% of manganese causes an increase in the weld hardenability, posing a problem of cold cracking in a weld zone. Therefore, the manganese content is limited to 0.70 wt% or less.

Chromium is an indispensable element, together with molybdenum, for imparting high-temperature strength, toughness, oxidation resistance and corrosion resistance which are required of steel plates for oil refinery, coal liquefaction and coal gasification equipment. At least 1.80 wt% of chromium must be contained in steel plates 75 mm or greater in thickness. The effect by the addition of chromium is heightened with an increase in its amount added. Accordingly, the chromium content increases as the plate thickness increases, but since there is a suspicion that more than 3.40 wt% of chromium lowers the workability and weldability of the resulting steel materials, chromium is added in amounts up to 3.40 wt%.

Molybdenum markedly raises the high-temperature tensile strength and the creep strength of steel materials. In order for molybdenum to provide high-temperature characteristics suitable for the abovesaid thick steel plate in combination with chromium, the molybdenum content is required to be at least 0.80 wt%. The more molybdenum is added, the more its effect is produced, but molybdenum is expensive and too large a molybdenum content impairs the weldability of the thick steel plate. Therefore, the upper limit of the molybdenum content is selected to be 1.20 wt%.

Aluminum, in particular, acid-soluble aluminum greatly contributes to improvement of strength and toughness of the steel by deoxidation and grain refining and serves to enhance the hardenability of boron. Especially, the latter function is exhibited in the steel of the composition of the present invention when the aluminum content is more than 0.035 wt%. With the aluminum content exceeding 0.1 wt%, however, deterioration of internal properties of steel and lowering of the toughness of the weld zone are caused; therefore, the aluminum content is selected to range from 0.035 to 0.1 wt%.

Boron suppresses the formation of proeutectoid ferrite during cooling of extremely thick steel plates of 75 mm or more from the normalizing temperature to promote transformation of the steel structure to bainite, thereby providing for increased strength and toughness. In the steel of the constitution according to the present invention, the abovesaid effect is not fully produced in the case of the boron content being less than 0.0010 wt%, whereas more than 0.0040 wt% of boron added impairs weldability. Therefore, the boron content is limited to the range from 0.0010 to 0.0040 wt%.

In the present invention, such impurities are allowable that are inevitably mixed in the steel meterials in ordinary steel-making processes. Generally speaking, it is preferred that sulfur be less than 0.030 wt% because it enhances the high-temperature cracking susceptibility, and that phosphorous be less than 0.015 wt% because it stimulates embrittlement while in use at high temperatures. Further, nitrogen refines grains together with aluminum to serve for increased toughness, so that nitrogen in amounts from 0.0020 to 0.0150 wt%, which is mixed in the ordinary steel-making processes, is effective. With more than 0.0150 wt% of nitrogen, however, blowholes are formed to degrade the properties of steel ingot and to deteriorate the weldability. Therefore, it is preferred to suppress the nitrogen content in the abovesaid range.

Next, a description will be given of limitation of the plate thickness specifically to 75 mm or more.

The cooling rate at the center of a 75 mm thick steel plate in its thickwise direction in ordinary normalizing treatment (air cooling from the normalizing temperature) is about 10° C. per minute at temperatures between 800° and 400° C. This cooling rate is one that permits the formation of the proeutectoid ferrite which causes a marked decrease in the strength of ordinary $2\frac{1}{4}$Cr-1Mo steel or 3Cr-1Mo steel with no boron contained. In the case where the plate thickness is larger than 75 mm and consequently the cooling rate is lower than the abovesaid one, the aforementioned constitution including boron greatly contributes to improvement of strength and toughness by virture of the transformation of the steel structure into bainite. In the case of a smaller plate thickness and hence higher cooling rate, however, the effect by the composition of the present invention is not so marked. In other words, when the plate thickness is smaller than 75 mm, sufficient strength and toughness can be obtained with the composition heretofore employed and, consequently, the present invention need not necessarily be used. For this reason, the plate thickness of the steel according to the present invention is limited specifically to 75 mm or greater.

The thick steel plate of the aforesaid composition is employed for oil refinery, coal liquefaction and coal gasification equipment, as referred to previously. The steel of the aforementioned composition according to the present invention is highly excellent in hydrogen attack resistance as well as in high-temperature tensile strength and creep strength, as mentioned previously, so that the steel of the present invention is of particular utility and economically advantageous for the abovesaid three applications which set out such requirements. Furthermore, only these three applications call for such extremely thick steel plates of 75 mm or greater. Accordingly, the steel of the present invention exhibits its advantages in terms of quality and economical property in these three applications only; therefore, it is preferred to restrict the steel of the present invention to these applications.

By the way, for a gas tank or like pressure vessel for use at room temperature which does not attach importance to the high-temperature tensile strength, the creep strength and the hydrogen attack resistance of the steel materials used, no use is made of steel materials containing large amount of expensive chromium and molybdenum such as the steel of the present invention but instead use is made of T.S.60 kgf/mm$^2$ class high-strength steels which are equal to the steel of the present invention in room-temperature strength and toughness only.

The foregoing description has been given of the composition, plate thickness and applications of the steel of the present invention. The steel of the present invention can easily be rendered into a predetermined product by obtaining a steel ingot, after adjusting the compositions of its raw materials, and rolling or forging it by a known method and then normalizing and tempering the rolled or forged product. In this case, the normalizing treatment includes an air cooling process and, in addition, a water cooling or an accelerated cooling process used for ultra-thick steel plates, that is, what is called a quenching process.

Next, a description will be given, with reference to Tables 1 and 2, of an embodiment of the present invention.

In Table 1, reference characters A to C indicate steels of the present invention and D a commercially available steel. In each of them, a 100 kg steel ingot obtained by the use of a small high-frequency induction heating type vacuum melting furnace was hot rolled into a 20 mm thick plate, which was further subjected to normalizing and tempering. In this normalizing treatment, the plate was heated in a heating furnace at 930° C. for two hours, after which the cooling rate in a temperature range from 800° to 400° C. at the center of the plate in its thickwise direction was adjusted, by sandwiching the plate between two ceramic fiber plates of 12.5 mm thick, to 4° C. per minute which corresponds to the cooling rate in the case of air cooling a 150 mm thick plate. The tempering treatment was performed under two heating conditions of 670° C.×15 h [T(20+log t): $20.0\times10^3$] and 720° C.×14 h [T(20+log t): $21.0\times10^3$].

The present invention is advantageous especially when an extremely thick steel plate of about 150 mm after being normalized is merely air cooled and when an ultra-thick steel plate of about 400 mm after being normalized is merely water cooled. The cooling rate at the center of the steel plate in its widthwise direction in the temperature range from 800° to 400° C. is about 4° C. per minute in the former case and about 9° C. per minute in the latter case. Accordingly, it is evident that if the effect of the present invention is proved in connection with the former case, then it will equally be produced in the latter case, too. For this reason, mechanical properties of normalized (air cooled)-tempered plates of 150 mm thick were examined.

Test pieces for tension test were each a 6 mm diameter rod having a 30 mm long parallel portion and test pieces for impact test were each a 2 mm V Charpy test piece. The results of tension and impact tests are as given in Table 2.

It is evident from Table 2 that the steels A, B and C according to the present invention are highly excellent in strength (yield point and tensile strength) and toughness under any tempering conditions, as compared with the steel D of the prior art.

By the way, the specified lower limit value of the tensile strength (T.S.) of ASTM A387-22, Class 2 which is typical of this kind of steels is 52.8 kg/mm$^2$. Data obtained in the case where the tempering condition was $21.0\times10^3$ in term of T(20+log t) show that the steels A, B and C of the present invention all exceed the above-said value, whereas the steel D of the prior art does not reach the value.

It will be apparent that many modifications and variations may be effected without departing from the scope of the novel concepts of the present invention.

TABLE 1

Chemical Compositions

| | Steels | C (wt%) | Si | Mn | P | S |
|---|---|---|---|---|---|---|
| A | Steels of present | 0.13 | 0.25 | 0.50 | 0.004 | 0.004 |
| B | invention | 0.14 | 0.25 | 0.50 | 0.004 | 0.004 |
| C | | 0.11 | 0.25 | 0.50 | 0.004 | 0.003 |
| D | Conventional Steel | 0.13 | 0.25 | 0.51 | 0.005 | 0.004 |

| | Steels | Al | Cr | Mo | B |
|---|---|---|---|---|---|
| A | Steels of present | 0.054 | 2.33 | 0.98 | 0.0012 |
| B | invention | 0.054 | 1.99 | 0.90 | 0.0017 |
| C | | 0.054 | 2.00 | 0.91 | 0.0019 |
| D | Conventional Steel | 0.018 | 2.34 | 1.00 | — |

TABLE 2

Mechanical Properties of 150 mm Thick Steel Plates

| Steels | | Mechanical properties: Tension test Y. P. kgf/mm$^2$ | T. S. kgf/mm$^2$ | El. % | R. A. % | 2 mm V - Charpy impact test E - 40 kgf.m | E - 20 kgf.m | EO kgf.m | vTrs °C. |
|---|---|---|---|---|---|---|---|---|---|
| Heat treatment 670° C. × 15 h, T (20 + log t):20.0 × 10$^3$ | | | | | | | | | |
| Steels of present invention | A | 51.8 | 65.1 | 25 | 77 | 20.7 | 24.4 | 25.5 | −81 |
| | B | 50.3 | 66.1 | 24 | 73 | 23.5 | 22.7 | 27.1 | −70 |
| | C | 50.1 | 62.3 | 25 | 77 | 26.0 | 26.8 | 26.8 | −59 |
| Conventional steel | D | 34.2 | 55.9 | 30 | 78 | 3.2 | 18.8 | 19.9 | −30 |
| Heat treatment 720° C. × 14 h, T (20 + log t):21.0 × 10$^3$ | | | | | | | | | |
| Steels of present invention | A | 44.8 | 59.7 | 30 | 76 | 20.5 | 21.5 | 22.7 | −62 |
| | B | 43.9 | 57.5 | 32 | 75 | 23.2 | 24.0 | 25.7 | −54 |
| | C | 42.1 | 55.6 | 32 | 78 | 22.0 | 25.0 | 26.0 | −61 |
| Conventional steel | D | 33.9 | 50.5 | 33 | 75 | 0.5 | 5.6 | 16.1 | −11 |

What is claimed is:

1. A Cr-Mo steel for use as 75 mm or more thick plates for oil refinery, coal liquefaction and coal gasification equipment, consisting of 0.09 to 0.17 wt% of carbon, 0.03 to 0.50 wt% of silicon, 0.45 to 0.70 wt% of manganese, more than 2.00 up to 3.40 wt% of chromium, 0.80 to 1.20 wt% of molybdenum, 0.035 to 0.1 wt% of aluminum, 0.0010 to 0.0040 wt% of boron and the balance iron and inevitable impurities, said steel being in bainitic condition.

* * * * *